United States Patent [19]

Seidel et al.

[11] 4,218,794

[45] Aug. 26, 1980

[54] HOLE-DRILLING AND FASTENER-DRIVING COMBINATION TOOL

[75] Inventors: Bernd Seidel, Stuttgart, Fed. Rep. of Germany; George G. Dewey, Prospect Heights, Ill.

[73] Assignee: Illinois Tool Works Inc., Chicago, Ill.

[21] Appl. No.: 23,519

[22] Filed: Mar. 23, 1979

[51] Int. Cl.[2] ..... B25F 3/00

[52] U.S. Cl. ..... 7/138; 30/158

[58] Field of Search ..... 7/138, 158, 165; 279/1 A, 1 E, 1 R; 145/50 B, 61 R, 116 R; 81/52.4 R, 54

[56] References Cited

U.S. PATENT DOCUMENTS

| | | | |
|---|---|---|---|
| 260,314 | 6/1882 | Parks et al. | |
| 986,829 | 3/1911 | Kasperson | 279/1 A |
| 1,209,362 | 12/1916 | Turner . | |
| 2,482,995 | 9/1949 | Willis . | |
| 3,484,114 | 12/1969 | Rodin | 279/1 R |
| 3,932,904 | 1/1976 | Nilsson | 7/165 |
| 3,965,510 | 6/1976 | Ernst | 7/165 |
| 3,973,784 | 8/1976 | Smith | 279/1 A |
| 4,007,795 | 2/1977 | Gawron | 145/66 |
| 4,107,800 | 8/1978 | Jorgensen | 7/158 |

*Primary Examiner*—Othell M. Simpson
*Assistant Examiner*—Roscoe V. Parker
*Attorney, Agent, or Firm*—Richard K. Thomson; Robert W. Beart

[57] ABSTRACT

A combination tool capable of drilling a hole in a workpiece, driving a fastener into that hole, and withstanding the vibrational environment of a rotary hammer is provided. An adaptor having a tapered portion which is inserted in the chuck of a power tool, such as a rotary hammer, has a polygonal drive transmitting configuration on its other end. A longitudinal bore extending at least partially along the axis of the adaptor receives a drill bit. The bit and bore have mating external and internal tapers to insure driving engagement. Once the bit has drilled a hole in a workpiece, a drive collar is slipped onto the polygonal drive transmitting portion of the adaptor and the fastener-engaging recess thereof used to drive a self-tapping fastener into that hole.

9 Claims, 7 Drawing Figures

HOLE-DRILLING AND FASTENER-DRIVING COMBINATION TOOL

BACKGROUND OF THE INVENTION

This application is related to U.S. application Ser. No. 18,382 filed Mar. 7, 1979.

This invention relates to a combination tool which can both drill a hole and, with minor modification, drive a self-tapping fastener into that hole.

Tools of this general type have been disclosed in commonly owned U.S. Pat. Nos. 3,965,510 and 4,107,800 which disclosures are hereby incorporated by reference. In each of those patents, a drill bit is retained in a mandrel by means of a setscrew. The mandrel has a stem portion which may extend from, or be telescopically received in, a sleeve. The sleeve has a fastener-engaging socket on the end opposite to that from which the stem projects. When the stem is in the forward position, it is contained within the sleeve and the drill bit is in its projecting or operative position. When the stem is in its rearward position, the drill bit is withdrawn into the sleeve and the socket is foremost such that it can engage and drive a fastener.

These combination tools have proved highly successful for most drilling and driving applications. However, certain limitations of these tools render them not entirely suitable for certain applications. More specifically, these tools are not well suited for use with the high-powered rotary hammer which is capable of both rotational and percussive driving. When subjected to the high vibration of such a driver, the setscrews which retain the drill bits in the above mentioned combination tools tend to vibrate loose, regardless of the amount of torque used to tighten them.

A further problem with these tools occurs with the larger drill sizes which, coincidentally, require the high powered tools to drive them and their corresponding fasteners. For every inch of length added to the drill bit, roughly two inches must be added to the tool, one inch to the sleeve and one inch to the stem which must reach through that sleeve. For the larger fastener sizes, this means the portion of the stem received in the driver is a substantial distance from the fastener-engaging socket and, even farther yet from the tip of the fastener which is penetrating the material. This means the tool itself is subjected to increased rotational and longitudinal bending torques and the fastener is subjected to a greater risk of canting or misalignment.

SUMMARY OF THE INVENTION

It is an object of this invention to provide a hole-drilling and fastener-driving combination tool suitable for use with a rotary hammer.

More particularly, it is an object of the invention to provide a hole-drilling and fastener-driving combination tool in which the means of connection will not loosen when subjected to vibration.

It is a further object of this invention to provide a hole-drilling and fastener-driving combination tool which has a relatively short distance between the portion inserted in the driver and fastener-engaging socket when the assembly is in the driving mode.

These and other objects of the invention are achieved by a tool including a one-piece, three sectioned drill bit means; a one piece adaptor; and a drive collar means. The adaptor has a tapered portion which fits directly into the chuck of a rotary hammer or similar power tool. The adaptor has a longitudinally-extending bore therethrough which receives a portion of the drill bit means . At least a portion of the bore and the corresponding section of the drill bit is tapered to form a frictional drive connection. Another section of the drill bit projects beyond the end of the bore and forms a knockout section. The adaptor has an outer portion which has a polygonal configuration which is received in a similarly shaped recess in the drive collar. The drill bit and adaptor are inserted in the chuck of the power tool and a hole is drilled into the workpiece. The drive collar, which has a fastener-engaging recess that may be removable, is then slipped over the drill bit and onto the adaptor which thereby drives it. The combination tool can now be used to drive a self-tapping fastener into the just drilled hole.

These and other objects and advantages of the present invention will be better understood by reference to the following detailed description taken in conjunction with the accompanying drawings.

DETAILED DESCRIPTION OF THE INVENTION

Figures 1, 2, 3, 4A, 4B, 4C, 5:
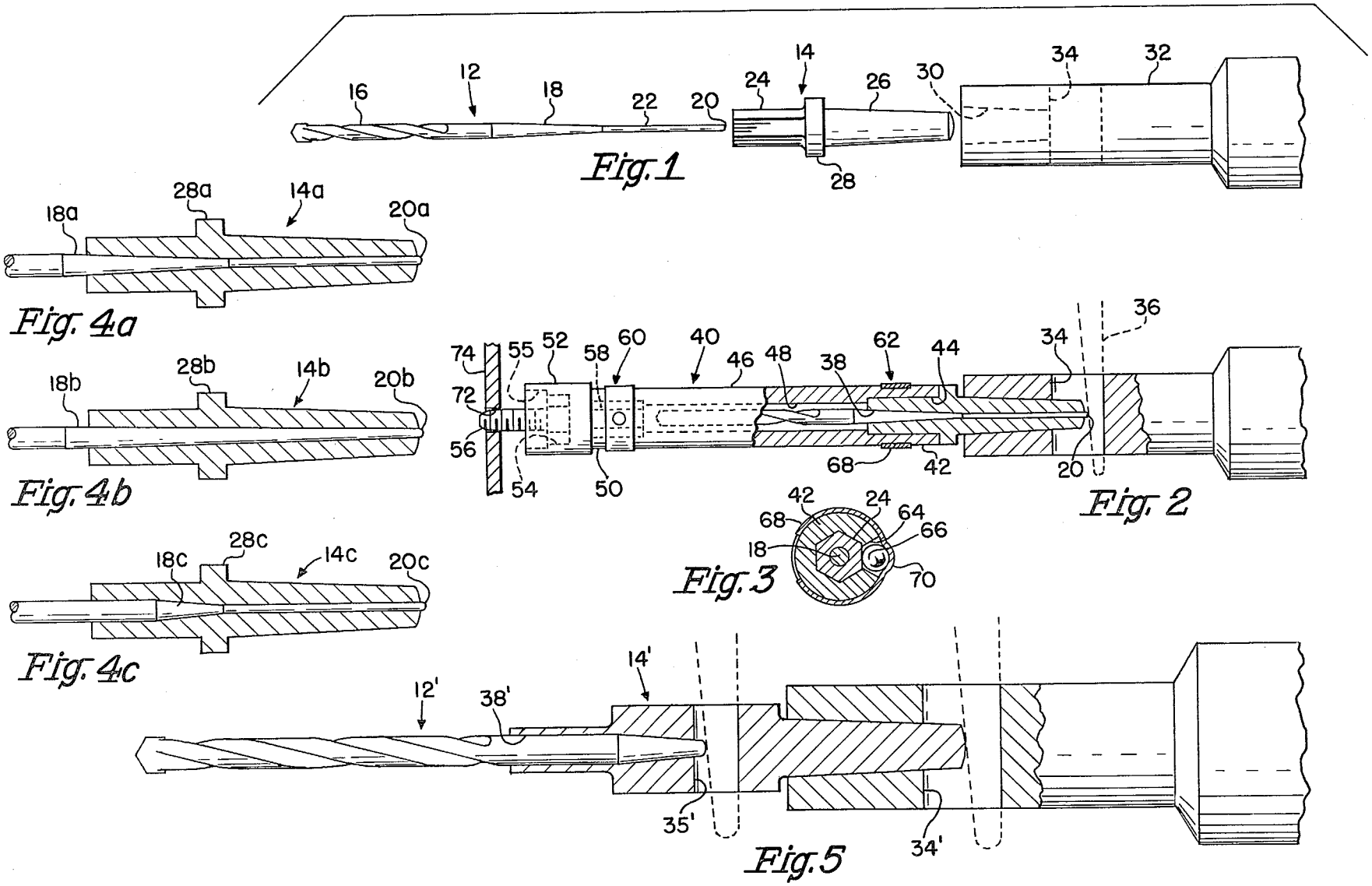
FIG. 1 is an exploded perspective view of the drilling portion of the combination tool.
FIG. 2 is a perspective view partially in section of the combination tool in its fastener driving mode.
FIG. 3 is a cross section of the assembled tool taken through the retainer.
FIGS. 4*a*, 4*b* and 4*c* depict three alternative configurations of the tapered section of the drill bit and tapered bore therefor; and, FIG. 5 is a perspective view in partial cross section of an alternate embodiment of the invention.

The components of the combination tool used in the drilling mode are shown in FIG. 1. The drill bit means is shown generally at 12 and the adaptor at 14. The drill bit has three basic sections: a first fluted drilling section 16; a second tapering section 18; and a third knockout section 20. In this, the preferred embodiment, the knockout section is formed at the end of a reduced cylindrical portion 22.

Adaptor 14 has a first outer portion 24 which has a polygonal configuration for reasons set forth hereinafter. The adaptor has a second outer portion 26 separated from the first by an annular flange 28. This second portion is tapered downwardly away from the flange and may be generally circular in cross section such that this end of the adaptor is generally frustoconical. Tapered portion 26 is adapted to be received in a similarly shaped aperture 30 in chuck 32 of a hammer drill or similar driving tool. The chuck has a radially extending opening 34 into which knockout wedge 36 can be inserted to aid removal of the drill bit and adaptor from the chuck.

As best seen in FIG. 2, adaptor 14 has a longitudinally extending axial bore 38 therein, at least a portion of which has a taper which is complementary to and adapted to receive and mate with tapered section 18 of the drill bit. These mating tapers form a sufficiently tight frictional drive such that no slippage occurs under load, in a manner that is well known in the art. The remaining portion of the bore in this embodiment is cylindrical and receives the similarly shaped portion 22 of the drill bit. Knockout section 20 extends beyond the longitudinal bore 38. When wedge 36 is inserted into opening 34, it will initially enage knockout section 20 permitting removal of the drill bit from adaptor 14. This will permit easy changing of a drill bit for a different size fastener without the need to remove or replace the adaptor. Further insertion into the opening will cause the wedge to break the frictional grip of the chuck on the tapered outer portion 26 permitting removal of the adaptor from the chuck.

Also shown in FIG. 2, is the drive collar means shown generally at 40. The drive collar has a first portion 42 which has an internal recess 44 which is complementary to the polygonal portion 24 of adaptor 14. A second portion 46 has a longitudinally extending bore 48 which has sufficient length and diameter to accomodate the largest fluted drill section 16 with which it will be used. A third portion 50 can include a removable socket 52 which has a fastener-engaging recess 54 which is adapted to engage and drive the head of a self-tapping fastener 56.

The socket has a hexagonal stem portion 58 integral therewith which is received in a similarly shaped recess of the body portion of the drive collar 40. The stem 58 of the socket is maintained in the recess by means of a spring-biased ball retainer 60. An identical retainer 62 is employed to hold the drive collar 40 on adaptor 14 and this retainer is shown in some detail in FIG. 3. A tapering hole 64 is formed through the wall of the drive collar in section 42 (and 50). The inner or minor diameter of the hole is less than the diameter of spherical ball 66. A strip of spring steel 68 extends about the periphery of the drive collar in a groove provided therefor. The spring strip 68 has a partial spherical indentation 70 which engages over the ball 66 and maintains the strip against rotational displacement. When the collar is slipped over the polygonal outer portion of the adaptor (depicted here as hexagonal), the lateral face of the hexagon engages the ball which is projecting into the hexagonal recess 44 and forces it outwardly against the bias of spring 68. This retainer increases the frictional forces and retains the respective members in engagement until manually separated. This retainer cannot be vibrated loose as can a setscrew. Although the drive transmitting shank 24 and its corresponding recess have been depicted as hexagonal, it will be understood that this shape is merely exemplary and other polygonal configurations are equally effective.

In operation, adaptor 14 is inserted into aperture 30 in the chuck. An appropriate sized drill bit 12 for the particular fastener 56 to be used, is selected and inserted in the adaptor. A hole 72 is then drilled in workpiece 74. The drive collar is then slipped over the drill bit 12 onto adaptor 14, an appropriate sized socket 52 having been preassembled on the body of the collar. Recess 54 engages and rotationally drives the head of the self-tapping fastener 56, advancing the fastener into hole 72. An enlarged non-driving recess 55, which has a depth equal to the thickness of the head, allows the head to be seated against the workpiece without danger of over-torquing. If the fastener were over-torqued, the threads in the workpiece could be stripped or the head of the fastener twisted off. It will be seen that the fastener-engaging recess can be kept comparitively close to the drive tool which is of particular importance with the more powerful drivers.

FIGS. 4*a*, 4*b*, and 4*c* indicate the three possible configurations of the tapered section 18 on the drill bit. FIG. 4*a* indicates the preferred configuration already described in which the taper begins outside the adaptor and the section 18*a* continuously tapers to a point beyond the flange 28*a*. FIG. 4*b* shows an alternative embodiment in which the taper begins outside the adaptor and is continuous through the knockout section 20*b*. A third alternative is depicted in FIG. 4*c* in which a cylindrical portion extends into the adaptor and tapered section 18*c* is totally contained by the adaptor 14*c*.

An alternative embodiment, particularly adapted for use with larger drill sizes, is shown in FIG. 5. In this embodiment, longitudinal bore 38' does not extend the entire length of the adaptor 14', but only to a second knockout opening 35' which is provided to remove the drill bit from the adaptor. In this embodiment, the elongated thin diameter portion 22 can be omitted making the larger diameter drill bits less subject to breakage.

It will be understood that the configuration of the different sized drills which are used with a particular adaptor will be standardized and that a number of sockets 52 will be provided for the different sized fastener heads. It should also be noted that this tool can be utilized to insert other types of fasteners such as certain types of expansion fasteners, for example. Further, it is contemplated that the spring steel biasing member 68 can be replaced by expedient biasing means such as an elastomeric ring.

I claim:

1. A hole-drilling and fastener-driving combination tool comprising a one-piece, three-sectioned drill bit means; a one-piece adaptor; and a drive collar means; said drill bit means having a first drilling section, a second tapering section, and a third knockout section; said adaptor having a first outer portion with a polygonal configuration, a second outer portion which is tapered and adapted to be received in a correspondingly shaped aperture of a power tool chuck, and an internal longitudinally extending bore, at least a portion of which has a taper that is complementary to that of the second section of the drill bit and adapted to mate therewith, said drilling section projecting from one end of said bore, in assembled condition, and said knockout section projecting beyond the other end of said longitudinal bore where it may be engaged by a knockout wedge; said drive collar means having a first portion with an internal recess which is complementary to the polygonal portion of the adaptor, a second portion which has a longitudinally extending bore therethrough of sufficient diameter and length to receive the drilling section, and a third portion which has a fastener-engaging recess; whereby, the tapered portion of the adaptor may be inserted in a complementary aperture in a chuck and frictionally driven thereby, the drill bit being inserted into said adaptor where it is frictionally retained and driven by said mating tapers such that a hole is drilled in a workpiece, said drive collar then being slipped onto said adaptor and used to rotationally advance a self-tapping fastener into the hole in said workpiece.

2. The combination tool of claim 1 wherein the chuck has a radially extending opening into which the end of said adaptor projects and which can receive said knockout wedge.

3. The combination tool of claim 2 wherein the longitudinal bore in said adaptor extends the entire length thereof.

4. The combination tool of claim 3 wherein said wedge will initially engage the knockout section and thereby dislodge said drill and, upon further advancement into said radial opening, engage the end of the adaptor dislodging it.

5. The combination tool of claim 2 wherein the adaptor has a separate radially-extending knockout opening therethrough for dislodging said drill.

6. The combination tool of claim 1 wherein the polygonal portion of the adaptor and the corresponding recess in the drive collar means are hexagonal.

7. The combination tool of claim 1 wherein the fastener-engaging recess is contained in a removable socket.

8. The combination tool of claim 7 wherein the socket has a hexagonal stem portion thereon held in a similarly shaped recess in a body portion of the drive collar means by a spring-biased ball means.

9. The combination tool of claim 1 wherein the drive collar means is retained on the polygonal portion of the adaptor by a spring-biased ball means.

* * * * *